US009913535B2

(12) United States Patent
Lin et al.

(10) Patent No.: US 9,913,535 B2
(45) Date of Patent: Mar. 13, 2018

(54) LOCKER SYSTEM AND METHOD FOR ADJUSTING ACCOMMODATING SPACE

(71) Applicant: Industrial Technology Research Institute, Hsinchu (TW)

(72) Inventors: Tsang-Gang Lin, Taipei (TW); Chen-Jyh Fan, Hsinchu County (TW); Ching-Tsung Cheng, New Taipei (TW); Chao-Hui Tu, Taoyuan (TW); Yung-Ping Tien, New Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 14/982,545

(22) Filed: Dec. 29, 2015

(65) Prior Publication Data

US 2017/0164735 A1 Jun. 15, 2017

(30) Foreign Application Priority Data

Dec. 14, 2015 (TW) ..... 104141876 A

(51) Int. Cl.

*A47B 57/00* (2006.01)
*A47G 29/30* (2006.01)
*A47G 29/14* (2006.01)

(52) U.S. Cl.

CPC ..... *A47B 57/00* (2013.01); *A47G 29/141* (2013.01); *A47G 29/30* (2013.01); *A47B 2220/0091* (2013.01)

(58) Field of Classification Search

CPC ..... A47B 57/00; A47B 2220/0091; A47G 29/30; A47G 29/141

(Continued)

(56) References Cited

U.S. PATENT DOCUMENTS 6,416,270 B1 * 7/2002 Steury ..... G07F 11/16 414/268
6,688,435 B1 * 2/2004 Will ..... G06Q 20/12 186/35

(Continued)

FOREIGN PATENT DOCUMENTS

CN 2838400 Y 11/2006
CN 202030107 U 11/2011

(Continued)

OTHER PUBLICATIONS

Taiwan Patent Office, Notice of Allowance, Patent Application Serial No. 104141876, dated Jun. 22, 2016, Taiwan.

*Primary Examiner* — Michael Collins

(57) ABSTRACT

A locker system includes a body, a driving unit, and a computer unit. The body includes a casing, a separating plate, horizontal plates, vertical plates and covering plates. The separating plate is disposed inside the casing to form an accommodating space and a storage space. The horizontal plates and the vertical plates are disposed inside the accommodating space and cooperate with the casing to form accommodating subspaces. Each covering plate is pivoted to the casing. The driving unit connects to the horizontal plates and the vertical plates. The computer unit obtains the size of an object. When the size of the object exceeds a preset size, the computer unit sends a driving signal to the driving unit, and the driving unit controls at least one horizontal plate or at least one vertical plate to move into the storage space according to the driving signal to accommodate the object.

20 Claims, 9 Drawing Sheets

(58) Field of Classification Search
USPC ..... 700/242–243
See application file for complete search history.

(56) References Cited

U.S. PATENT DOCUMENTS

| | | | | |
|---|---|---|---|---|
| 6,694,217 | B2 * | 2/2004 | Bloom | G06Q 20/00 700/215 |
| 7,809,470 | B2 * | 10/2010 | Shoenfeld | G08B 13/14 221/123 |
| 8,234,008 | B2 * | 7/2012 | Weber | A47B 67/02 221/130 |
| 9,135,216 | B2 * | 9/2015 | Stark | G07F 11/165 |
| 2002/0177922 | A1 * | 11/2002 | Bloom | G06Q 20/00 700/213 |
| 2016/0325933 | A1 * | 11/2016 | Stiernagle | B65G 1/0492 |
| 2016/0325934 | A1 * | 11/2016 | Stiernagle | B25J 9/1679 |

FOREIGN PATENT DOCUMENTS

| | | | |
|---|---|---|---|
| CN | 102991812 | A | 3/2013 |
| CN | 203828366 | U | 9/2014 |
| CN | 203994968 | U | 12/2014 |
| CN | 203997225 | U | 12/2014 |
| CN | 203997346 | U | 12/2014 |
| CN | 303017493 | S | 12/2014 |
| CN | 303017494 | S | 12/2014 |
| CN | 204351373 | U | 5/2015 |
| CN | 204561426 | | 8/2015 |
| CN | 105054610 | | 11/2015 |
| TW | 315814 | | 9/1997 |
| TW | 527894 | | 4/2003 |
| TW | M246249 | | 10/2004 |
| TW | M269776 | | 7/2005 |
| TW | 200535065 | | 11/2005 |
| TW | M288131 | | 3/2006 |
| TW | M305621 | | 2/2007 |
| TW | M393254 | | 12/2010 |
| TW | I347291 | | 8/2011 |
| TW | I413594 | | 11/2013 |
| TW | M464423 | | 11/2013 |
| TW | M464633 | | 11/2013 |
| TW | M467639 | | 12/2013 |
| TW | I445648 | | 7/2014 |
| TW | 201502032 | | 1/2015 |
| TW | M499148 | | 4/2015 |
| TW | M500743 | | 5/2015 |

* cited by examiner

LOCKER SYSTEM AND METHOD FOR ADJUSTING ACCOMMODATING SPACE

FIELD OF THE DISCLOSURE

The disclosure relates to a locker system, and related to a locker system capable of adjusting the accommodating space automatically and a method for adjusting the accommodating space according to the size of an object which is to be stored.

BACKGROUND

In modern life, traveling around the world is a very common leisure activity, and people usually bring luggage to travel. However, when people want to go shopping, it is a great burden to go shopping with luggage. Therefore, the traveler generally stores the luggage in a locker at a station, and then goes shopping. At present, a common locker usually includes several accommodating spaces with a few fixed sizes. For example, an accommodating space of a small size is for storing leather bags, an accommodating space of a middle size is for storing hand baggage, and an accommodating space of the largest size is for storing luggage cases.

However, the number of lockers with different sizes is limited, so people usually find that the size of locker that they need is not available, and they may use another locker of another size. When the size of an available locker has a larger accommodating space than the people need, the extra space is not used and is wasted. Consequently, it is a big issue to consider and study to develop a locker whose accommodating spaces can be used properly.

SUMMARY

An embodiment of the disclosure discloses a locker system including a body, a driving unit, and a computer unit. The body includes a casing, a separating plate, a plurality of horizontal plates, a plurality of vertical plates and a plurality of covering plates. The separating plate is disposed inside the casing so as to form an accommodating space and a storage space. The plurality of horizontal plates and the plurality of vertical plates are disposed inside the accommodating space and cooperate with the casing to form a plurality of accommodating subspaces. Each covering plate is pivoted to the casing. The driving unit connects to the plurality of horizontal plates and the plurality of vertical plates. The computer unit obtains the size of an object. The size of the object includes the height and length of the object, and a preset size is stored in the computer unit, and the preset size includes the height and length of the accommodating subspace. When the size of the object exceeds the preset size, the computer unit sends a driving signal to the driving unit, and the driving unit controls at least one horizontal plate or at least one vertical plate to move into the storage space according to the driving signal, so as to accommodate the object.

Another embodiment of the disclosure discloses a locker system including a body, a driving unit and a computer unit. The body includes a casing, a separating plate, a plurality of horizontal plates, a plurality of vertical plates and a plurality of covering plates. The separating plate is disposed inside the casing so as to form an accommodating space and a storage space. The plurality of horizontal plates and the plurality of vertical plates are disposed inside the accommodating space and cooperate with the casing to form a plurality of accommodating subspaces. Each covering plate is pivoted to the casing. The driving unit connects to the plurality of vertical plates. The computer unit obtains the size of an object. The size of the object includes the height of the object, and a preset size is stored in the computer unit, and the preset size includes the height of the accommodating subspace. When the size of the object exceeds the preset value, the computer unit sends a driving signal to the driving unit, and the driving unit controls at least one vertical plate to move into the storage space according to the driving signal, so as to accommodate the object.

According to the disclosure, the disclosure discloses a method for adjusting accommodating space, applied to a locker system. The locker system includes a casing, an accommodating space, a storage space, a plurality of horizontal plates, a plurality of vertical plates, and a driving unit. The plurality of horizontal plates and the plurality of vertical plates cooperate with the casing to form a plurality of accommodating subspaces. The driving unit is connected to the plurality of horizontal plates and the plurality of vertical plates. The method includes: obtaining the size of an object; determining whether the size of the object exceeds a preset size; when the size of the object exceeds the preset size, sending a driving signal to the driving unit according to the size of the object; controlling at least one horizontal plate or at least one vertical plate to move into the storage space according to the driving signal; and accommodating the object in at least two accommodating subspaces.

DETAILED DESCRIPTION OF THE DISCLOSURE

Figure 1:
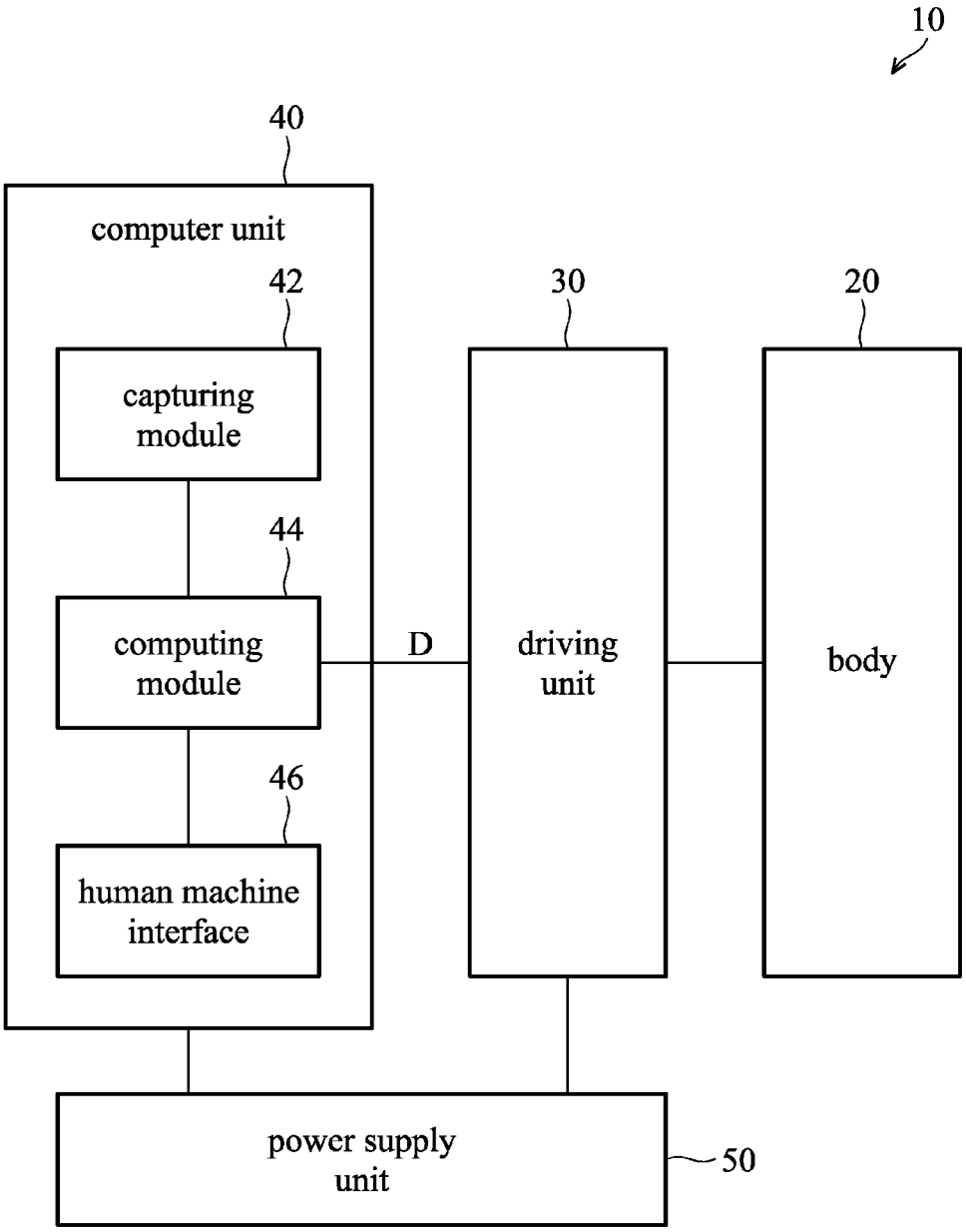
FIG. 1 is a functional diagram of a locker system according to an embodiment of the disclosure.

The following description provides different embodiments and examples for implement different features of the disclosure. For convenience of description, the spatial terms "up", "down", "left", "right", "under", "above" are used to describe the relationship between one component or part with another (or some) component(s) or part(s) illustrated in the drawings. In addition to the orientation shown in the drawings, the spatial terms are directed to include different orientation of devices in use or in operation. The device can be oriented in other manner (rotates to 90 degrees or other orientation), and the spatial relationship descriptors used herein can be similarly interpreted accordingly.

Please refer to FIG. 1. FIG. 1 is a functional diagram of a locker system 10 according to an embodiment of the disclosure. The locker system 10 includes a body 20, a driving unit 30, a computer unit 40 and a power supply unit 50. The power supply unit 50 is arranged to provide electricity to the driving unit 30 and the computer unit 40. The driving unit 30 is disposed inside the body 20 and connected to components of the body 20. The computer unit 40 is arranged to obtain a size of an object (not shown in figures), and the size of the object includes the height and length of the object. The computer unit 40 can include an image capturing module 42 and a computing module 44. The capturing module 42 can be a camcorder or a camera recorder for capturing an image of the object. The capturing module 42 transmits the image to the computing module 44, and the computing module 44 computes the size of the object according to the image. A method for obtaining the size of the object can be implemented based on the method disclosed in Taiwan Patent No. I494538.

Furthermore, the computer unit 40 can further includes a human machine interface 46, and the human machine interface 46 can be a touch screen, but is not limited thereto. When a user already knows the size of the object, the user can directly input the size of the object via the human machine interface 46. The computing module 44 can store a preset size, and the preset size can include information related to the size of the body 20.

Figure 2A:
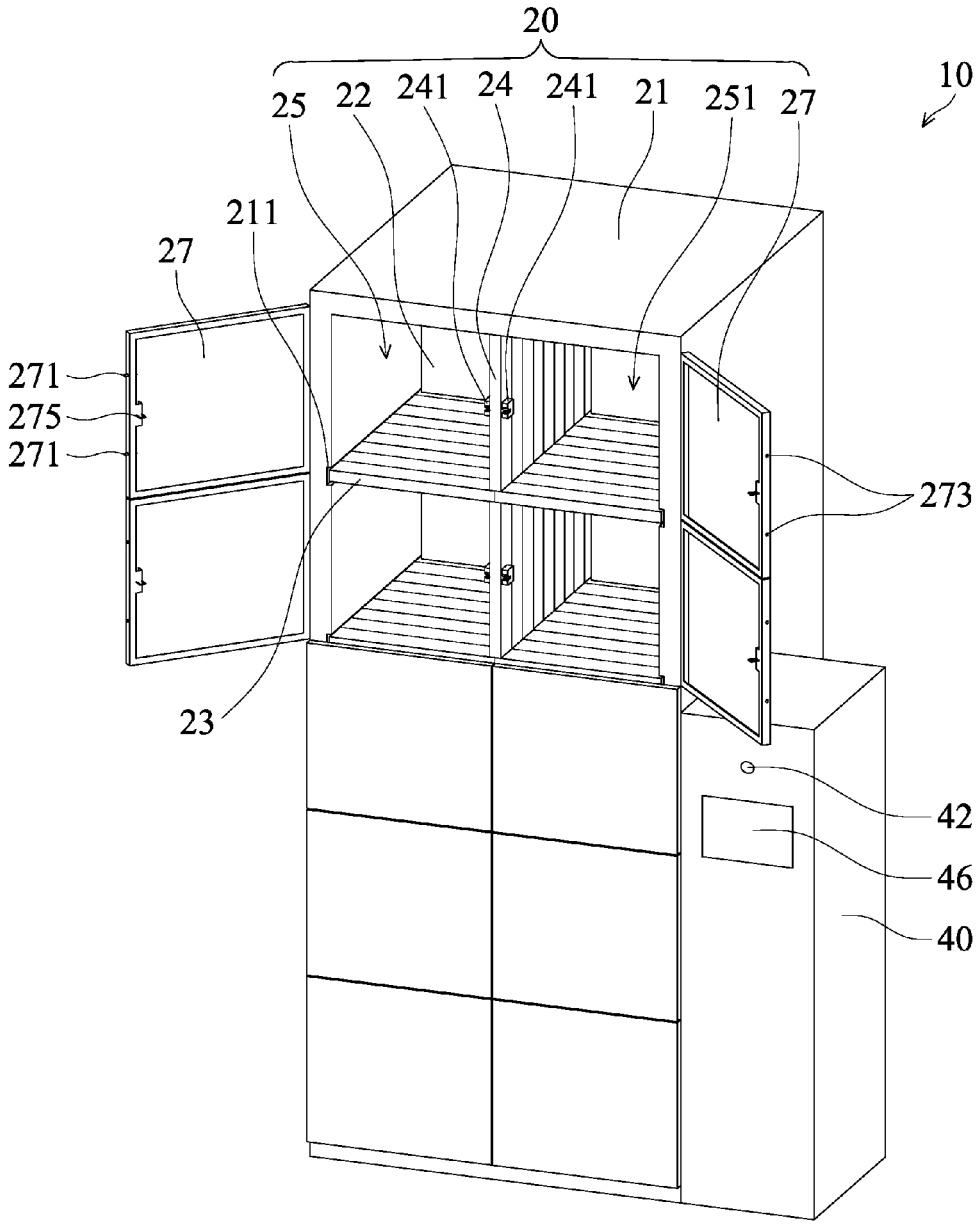
FIG. 2A is a diagram of the locker system according to the embodiment of the disclosure.
Figure 3:
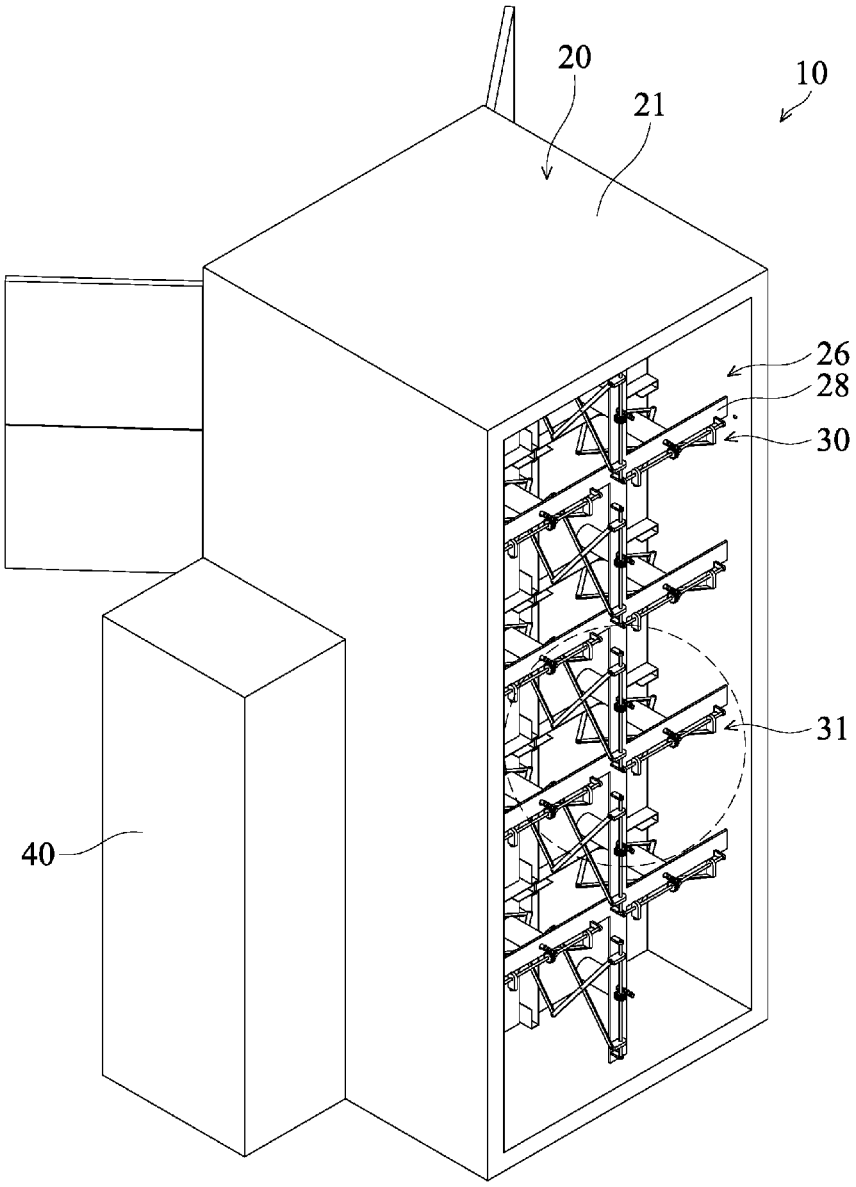
FIG. 3 is a diagram illustrating that a driving unit is disposed in a casing according to the embodiment of the disclosure.

Please refer to FIG. 2A and FIG. 3. FIG. 2A is a diagram of the locker system 10 according to the embodiment of the disclosure, and FIG. 3 is a diagram illustrating that the driving unit 30 is disposed in a casing 21. The body 20 includes a casing 21, a separating plate 22, a plurality of horizontal plates 23 and a plurality of vertical plates 24. The separating plate 22 is disposed inside the casing 21, so as to divide a space of the casing 21 to form an accommodating space 25 and a storage space 26. The plurality of horizontal plates 23 and the plurality of vertical plates 24 are disposed in the accommodating space 25, and divide the accommodating space 25 into a plurality of accommodating subspaces 251. The body 20 further includes a plurality of tracks 211 disposed on an inner surface of the casing 21. The track 211 is for guiding a corresponding horizontal plate 23 to move and supporting the corresponding horizontal plate 23. In an embodiment, the horizontal plates 23 or the vertical plates 24 are plates which cannot be folded, and the storage space 26 can store the horizontal plates 23 or the vertical plates 24. In another embodiment, each horizontal plate 23 or each vertical plate 24 has creases, and is made of soft plastic. Therefore, each horizontal plate 23 or each vertical plate 24 is a stretchable plate which can be folded. The driving unit 30 is disposed in the storage space 26 and connected to the plurality of horizontal plates 23 and the plurality of vertical plates 24.

Figure 2B:
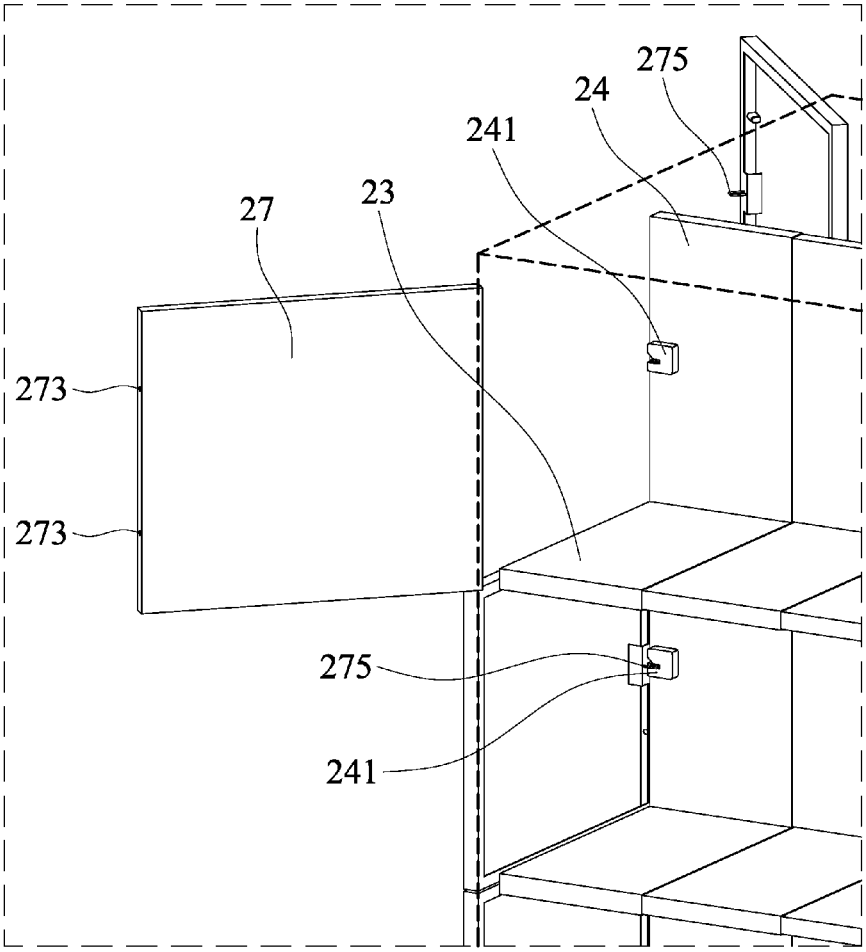
FIG. 2B is a diagram illustrating that an electromagnetic lock locks an engaging ring according to the embodiment of the disclosure.

The body 20 further includes a plurality of covering plates 27. Each covering plate 27 is pivoted to the casing 21. In this embodiment, the number of covering plates 27 and the number of accommodating subspaces 251 are the same, but they are not limited thereto. Two covering plates 27 at the same horizontal level pivot relative to the casing 21 in two opposite directions. An electromagnetic latch 271 is disposed on one of the two covering plates 27, and a hole 273 is formed on the other one of the two covering plates 27. The computer unit 40 controls the electromagnetic latch 271 to insert itself into the hole 273, so that the two covering plates 27 are fixed to each other. Moreover, please refer to FIG. 2B with previous figures. FIG. 2B is a diagram illustrating that an electromagnetic lock 241 locks an engaging ring 275 according to the embodiment of the disclosure. Two electromagnetic locks 27 are disposed on each vertical plate 24, and the two electromagnetic locks 241 are disposed on two sides of the vertical plate 24 and are electrically connected to the computer unit 40. An engaging ring 275 is disposed on each covering plate 27. When the covering plate 27 covers the casing 21, the computer unit 40 controls the electromagnetic lock 241 to lock the engaging ring 275.

When the user needs to combine an accommodating subspace 251 on the left side with an accommodating subspace 251 on the right side, the vertical plate 24 is driven back into the storage space 26, so as to form a larger horizontal space for placing appropriate items, such as goods, luggage cases, or bags. Because the vertical plate 24 is drawn back into the storage space 26, the engaging ring 275 cannot be locked by the electromagnetic lock 241. Therefore, after the two covering plates 27 cover the casing 21, the computer unit 40 controls the electromagnetic latch 271 of the covering plate 27 on the left side to insert itself into the hole 273 of the covering plate 27 on the right side.

When the user needs to combine an upper accommodating subspace 251 with a lower accommodating subspace, the horizontal plate 23 is driven back into the storage space 26, so as to form a larger vertical space for placing appropriate items, such as goods, luggage cases, or bags. Because the horizontal plate 23 is drawn back into the storage space 26, the computer unit 40 controls two electromagnetic locks 241 on the vertical plates 24 to lock two engaging rings 275 respectively after the covering plate 27 at the upper side and the covering plate 27 at the lower side cover the casing 21.

When the user needs to combine an accommodating subspace 251 on the upper left side, an accommodating subspace 251 on the lower left side, an accommodating subspace 251 on the upper right side and an accommodating subspace 251 on the lower right side, two horizontal plates 23 and two vertical plates 24 are driven back into the storage space 26, so as to form a larger space for placing appropriate items, such as goods, luggage cases, or bags. Because the two horizontal plates 23 and two vertical plates 24 are drawn back into the storage space 26, the engaging rings 275 cannot be locked by the corresponding electromagnetic locks 241. Therefore, after the four covering plates 27 cover the casing 21, the computer unit 40 controls the electromagnetic latches 271 of the two covering plates 27 on the left side to insert themselves into the holes 273 of the two covering plates 27 on the right side.

The preset size of the computing module 44 includes the height and length of the accommodating subspace 251. When the size of the object exceeds the preset size, the computer unit 40 sends a driving signal D to the driving unit 30. Then the driving unit 30 controls at least one horizontal plate 23 or at least one vertical plate 24 to move into the storage space 26 according to the driving signal D, so as to accommodate the object. For example, when the width of the object to be stored is greater than the width of the accommodating subspace 251, the driving unit 30 drives the vertical plate 24 of a first layer to move into the storage space 26 according to the driving signal D, so that the object can be accommodated by two accommodating subspaces 251 of the first layer. For example, when the height of the object to be stored is greater than the height of the accommodating subspace 251, the driving unit 30 drives the horizontal plate 23 on the left side of the first layer to move into the storage space 26 according to the driving signal D, so that the two accommodating subspaces 251 on the left side can accommodate the object. For example, when the width of the object to be stored is greater than the width of the accommodating subspace 251, and the height of the object to be stored is greater than the height of the accommodating subspace 251, the driving unit 30 drives the two horizontal plates 23 of the first layer and two vertical plates 24 adjacent to the two horizontal plates 23, to move into the storage space 26 according to the driving signal D, so that four accommodating subspaces 251 can accommodate the object.

Please refer to FIG. 3, in which the body 20 further includes a frame 28 disposed in the storage space 26, and the driving unit 30 includes a plurality of control modules 31. The plurality of control modules 31 is fixed to the frame 28, and the plurality of control modules 31 is respectively connected to corresponding vertical plates 24 and/or corresponding horizontal plates 23, so as to control the corresponding vertical plate 24 or the corresponding horizontal plate 23 to move between the accommodating space 25 and the storage space 26. In this embodiment, the number of control modules 31 is equal to the sum of the plurality of horizontal plates 23 and the plurality of vertical plates 24, but it is not limited thereto.

Figure 4:
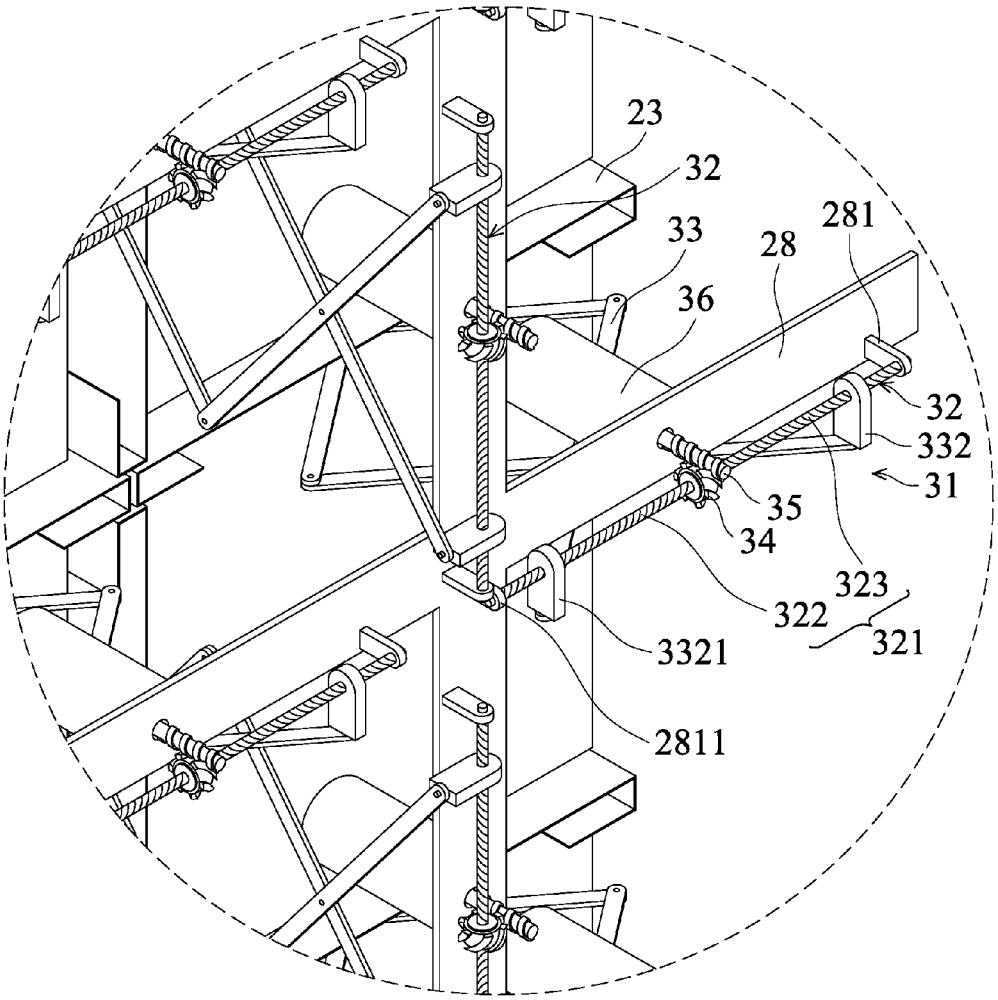
FIG. 4 is a diagram of a control module according to the embodiment of the disclosure.
Figure 5:
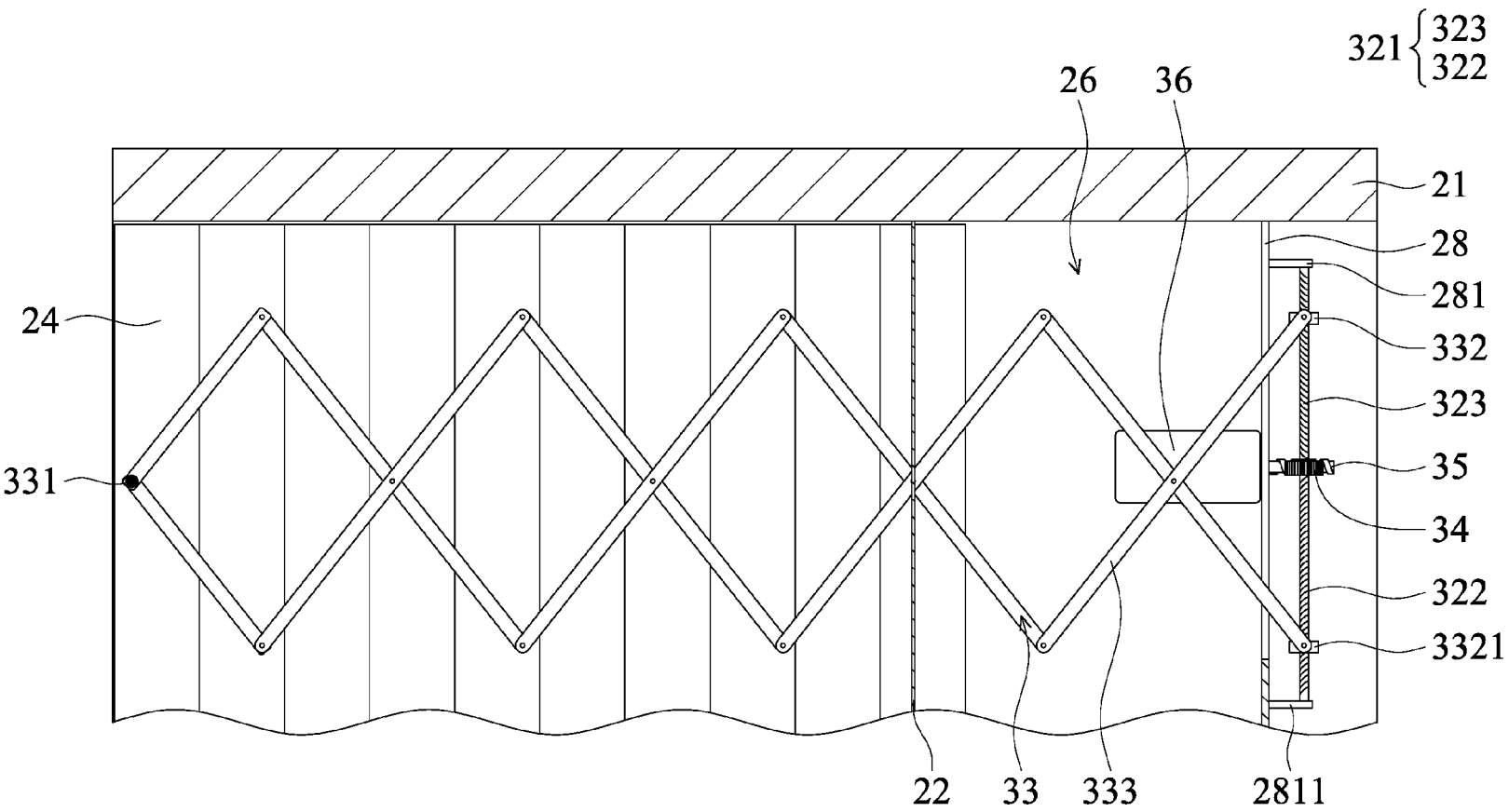
FIG. 5 and FIG. 6 are diagrams illustrating that the control module controls a vertical plate in different statuses according to the embodiment of the disclosure.
Figure 6:
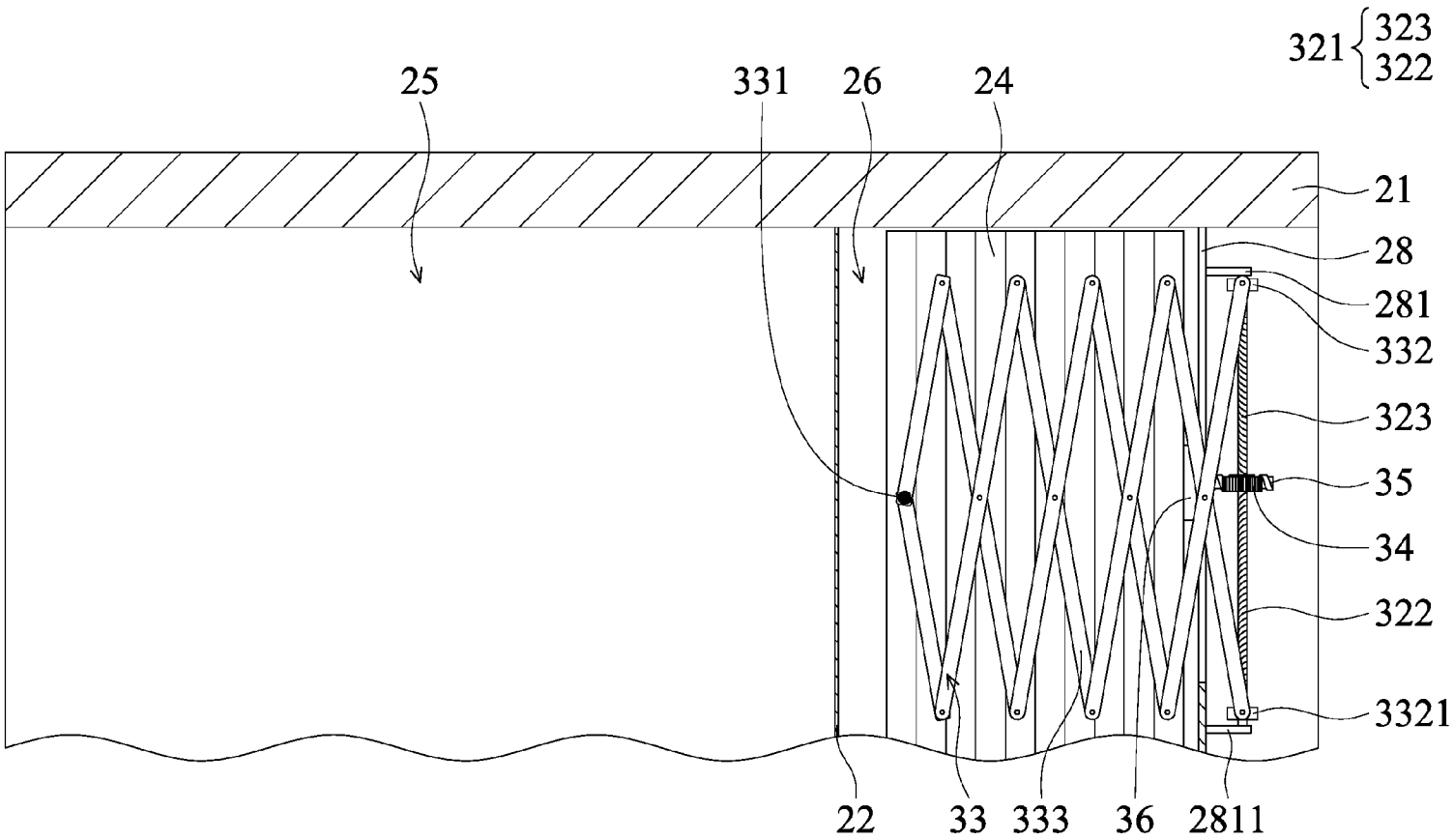

Please refer to FIG. 4 to FIG. 6. FIG. 4 is a diagram of the control module 31 according to the embodiment of the disclosure. FIG. 5 and FIG. 6 are diagrams illustrating that the control module 31 controls the vertical plate 24 in different statuses according to the embodiment of the disclosure. The control module 31 includes a screw rod 32, a stretchable structure 33, a worm gear 34, a worm shaft 35, and a motor 36. The screw rod 32 is connected to a first connection component 281 and a second connection component 2811 on the frame 28. The screw rod 32 can rotate relative to the first connection component 281 and the second connection component 2811. The worm gear 34 is fixed on a middle position of the screw rod 32. The screw rod 32 has screw threads 321. The left screw threads 322 of the screw threads 321 are on the left side of the worm gear 34, and the right screw thread 323 are on the right side of the worm gear 34. The left screw threads 322 and the right screw thread 323 are formed in opposite directions. The stretchable structure 33 includes a fixed portion 331, a first connection portion 332, a second connection portion 3321, and a rod portion 333. A front end of the rod portion 333 is connected to the fixed portion 331, and the fixed portion 331 is fixed to a front end of the corresponding vertical plate 24 or a front end of the corresponding horizontal plate 23. The first connection portion 332 and the second connection portion 3321 are connected to a rear end of the rod portion 333 and are coupled to the screw threads 321 of the screw rod 32. The worm shaft 35 is coupled to the worm gear 34. The motor 36 is disposed on the frame 28 securely, and the motor 36 is connected to the worm shaft 35. In one embodiment, the rod portion 333 is composed of several rods, which are connected to each other and are arranged in the shape of a cross, so that the stretchable structure 33 can be stretched. In one embodiment, the control module 31 controls the horizontal plate 23, or the control module 31 controls the vertical plate 24.

As shown in FIG. 5 and FIG. 1, when the driving unit 30 receives the driving signal D from the computer unit 40, the motor 36 drives the worm shaft 35 in a direction such as a counterclockwise direction, to drive the worm gear 34 and the screw rod 32 to rotate, so that the first connection portion 332 and the second connection portion 3321 move along the right screw thread 323 and the left screw threads 322 respectively. The first connection portion 332 moves upward along the right screw thread 323, and the second connection portion 3321 moves downward along the left screw threads 322, so that the rod portion 333 of the stretchable structure 33 moves rightward and drives the vertical plate 24 to move rightward. As shown in FIG. 6, the vertical plate 24 can be folded and stored in the storage space 26 behind the separating plate 22. In addition, when the motor 36 drives the worm shaft 35 in the opposite direction such as a clockwise direction, to rotate, the first connection portion 332 moves downward along the right screw thread 323, and the second connection portion 3321 moves upward along the left screw threads 322, so that the stretchable structure 33 moves leftward and drives the vertical plate 24 to move leftward. Each of the first connection portion 332 and the second connection portion 3321 has a threaded hole, and the threaded hole of the first connection portion 332 and the threaded hole of the second connection portion 3321 are coupled to the screw threads 321 of the screw rod 32. Therefore, the first connection portion 332 and the second connection portion 3321 can move inward or outward at the same time according to the rotation of the screw rod 32, so as to stretch the stretchable structure 33.

Figure 7:
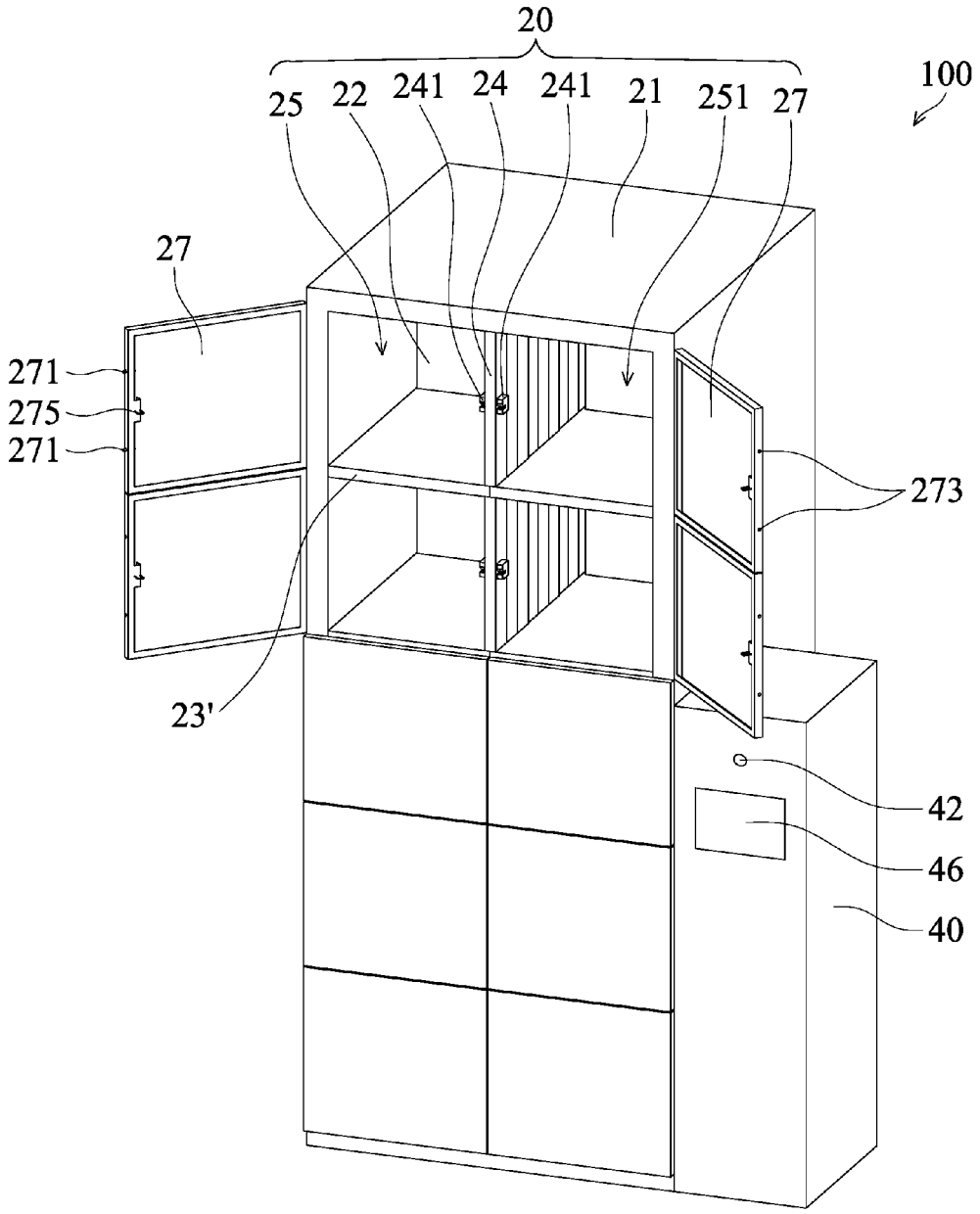
FIG. 7 is a diagram of a locker system according to another embodiment of the disclosure.

Please refer to FIG. 7. FIG. 7 is a diagram of a locker system 100 according to another embodiment of the disclosure. Differences between this embodiment and the previous embodiment are that the horizontal plates 23' of the locker system 100 are metal plates which are fixed directly to the inner surface of the casing 21, and the control modules 31 connect to the plurality of vertical plates 24. That is, the locker system 100 can drive the vertical plates 24 to move. An advantage of this embodiment is that the horizontal plate 23' can support a heavy object. Other structures and functions of the locker system 100 are the same as in locker system 10, and therefore descriptions of them are omitted herein.

Figure 8:
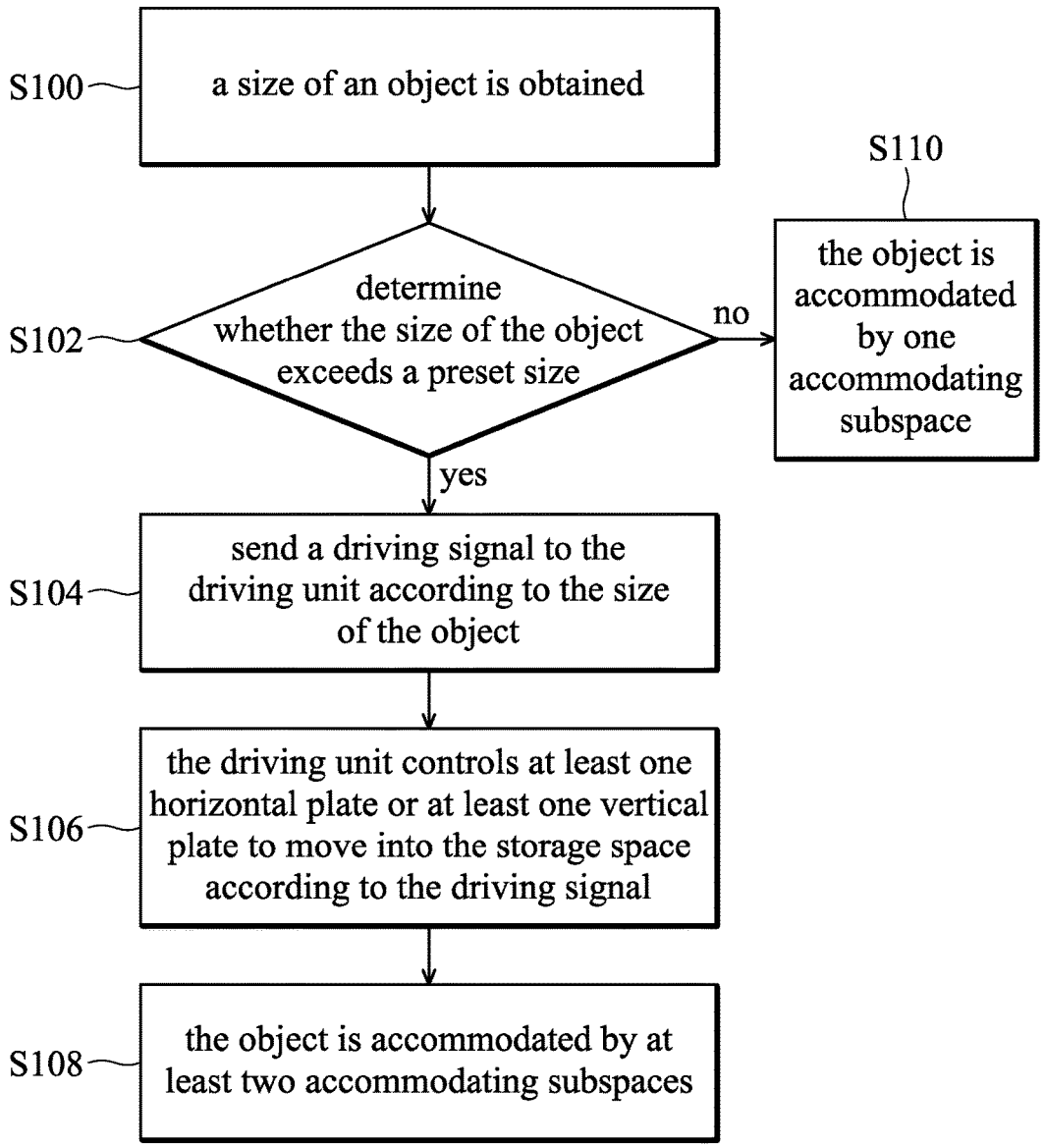
FIG. 8 is a flowchart of a method for adjusting accommodating space according to the embodiment of the disclosure.

Please refer to FIG. 8. FIG. 8 is a flowchart of a method for adjusting an accommodating space according to the embodiment of the disclosure. In step S100, the size of an object is obtained by the capturing module 42 and the computing module 44 of the computer unit 40. The capturing module 42 can capture an image of the object, and then the computing module 44 obtains the size of the object according to the image. In addition, the user can directly input the size of the object through the human machine interface 46, so that the computer unit 40 can receive the size of the object. In step S102, the computing module 44 determines whether the size of the object exceeds a preset size. If yes, step S104 is performed, and if no, step S110 is performed. In step S104, the computing module 44 computes the size of a space which can accommodate the object, and sends a driving signal D to the driving unit 30. In step S106, the driving unit 30 controls at least one horizontal plate 23 or at least one vertical plate 24 to move into the storage space 26 according to the driving signal D. In step S108, the object is accommodated in at least two accommodating subspaces 251. In step S110, the object is accommodated in one accommodating subspace 251.

The disclosure provides a locker system in which the computer unit 40 computes and obtains the size of the object to be stored first, and then sends the driving signal D to the driving unit 30. The driving unit 30 controls the vertical plates 24 and/or the horizontal plates 23 whose amounts are requested by the driving signal D, to move into the storage space 26, so as to accommodate objects of different sizes. Therefore, the disclosure solves the problem in the prior art wherein a locker has a fixed size, and the space of the locker cannot be utilized properly.

The disclosure can to solve the problem wherein the accommodating space of a locker is wasted. Therefore, the disclosure is to provide a locker system and a method for adjusting accommodating spaces, so as to solve this problem.

The disclosure is to accommodate objects of different sizes, so that the accommodating space is properly used.

The disclosure provides a locker system, the computer unit computes and obtains the size of the object which is to be stored, and then sends the driving signal to the driving unit. The driving unit controls the vertical plates and/or the horizontal plates whose amounts are requested by the driving signal, to move into the storage space, so as to accommodate objects of different sizes. Therefore, the disclosure solves the problem wherein a locker of the prior art has a fixed size so that the space of the locker cannot be utilized properly.

What is claimed is:

1. A locker system, comprising:

a body, comprising:

a casing;

a separating plate, disposed inside the casing so as to divide an interior space of the casing into an accommodating space at one side of the separating plate and a storage space at the other side of the separating plate;

a plurality of horizontal plates;

a plurality of vertical plates, the plurality of horizontal plates and the plurality of vertical plates disposed inside the accommodating space and cooperating with the casing to form a plurality of accommodating subspaces; and a plurality of covering plates, each covering plate being pivoted to the casing;

a driving unit, connected to the plurality of horizontal plates and the plurality of vertical plates; and a computer unit, obtaining a size of an object, wherein the size of the object comprises a height and a length of the object, a preset size is stored in the computer unit, the preset size comprises a height and a length of the accommodating subspace, when the size of the object exceeds the preset size, the computer unit sends a driving signal to the driving unit, and the driving unit controls at least one horizontal plate or at least one vertical plate to move into the storage space according to the driving signal, so as to accommodate the object.

2. The locker system as claimed in claim 1, wherein the computer unit comprises:

an image capturing module, capturing an image of the object; and a computing module, obtaining the size of the object according to the image.

3. The locker system as claimed in claim 1, wherein the computer unit further comprises a human machine interface receiving the size of the object.

4. The locker system as claimed in claim 1, wherein the body further comprises a frame disposed in the storage space, and the driving unit comprises a plurality of control modules, the plurality of control modules is respectively fixed to the frame, and the plurality of control modules is respectively fixed to corresponding vertical plates or corresponding horizontal plates, so as to control the corresponding vertical plate or the corresponding horizontal plate to move between the accommodating space and the storage space.

5. The locker system as claimed in claim 4, wherein the control module comprises:

a screw rod connected to a first connection component and a second connection component on the frame, the screw rod having screw threads;

a stretchable structure comprising a fixed portion, a first connection portion and a second connection portion, the fixed portion being fixed to the corresponding vertical plate or the corresponding horizontal plate, and the first connection portion and the second connection portion being coupled to the screw threads of the screw rod;

a worm gear fixed on a middle position of the screw rod;

a worm shaft coupled to the worm gear; and a motor disposed on the frame and connected to the worm shaft, wherein the motor drives the worm shaft to rotate thereby driving the worm gear and the screw rod according to the driving signal, so that the first connection portion and the second connection portion move along the screw threads of the screw rod, and then the stretchable structure drives the corresponding vertical plate or the corresponding horizontal plate to move.

6. The locker system as claimed in claim 1, wherein the vertical plates or the horizontal plates are stretchable plates, and are made of soft plastic.

7. The locker system as claimed in claim 1, wherein when a height of the object is greater than a height of the accommodating subspace, the driving unit drives at least one of the horizontal plates to move into the storage space according to the driving signal of the computer unit, so that at least two accommodating subspaces accommodate the object.

8. The locker system as claimed in claim 1, wherein when the length of the object is greater than the length of the accommodating subspace, the driving unit drives at least one of the vertical plates to move into the storage space according to the driving signal of the computer unit, so that at least two accommodating subspaces accommodate the object.

9. The locker system as claimed in claim 1, wherein when the length of the object is greater than the length of the accommodating subspace, and the height of the object is greater than the height of the accommodating subspace, the driving unit drives two of the horizontal plates and two vertical plates adjacent to the two of the horizontal plates to move into the storage space according to the driving signal of the computer unit, so that four accommodating subspaces accommodate the object.

10. The locker system as claimed in claim 1, wherein two electromagnetic locks are disposed on each plate, an engaging ring is disposed on each covering plate, the two electromagnetic locks are electrically connected to the computer unit, and the computer unit controls the electromagnetic lock to lock the engaging ring when the covering plate covers the casing.

11. The locker system as claimed in claim 10, wherein two covering plates at the same horizontal level pivot relative to the casing in two opposite directions, an electromagnetic latch is disposed on one of the two covering plates, a hole is formed on the other one of the two covering plates, and the computer unit controls the electromagnetic latch to insert itself into the hole, so that the two covering plates are fixed to each other.

12. The locker system as claimed in claim 1, wherein the body further comprises a plurality of tracks formed on an inner surface of the casing, and the tracks are for guiding and supporting the horizontal plates.

13. A locker system, comprising:

a body, comprising:

a casing;

a separating plate, disposed inside the casing so as to divide an interior space of the casing into an accommodating space at one side of the separating plate and a storage space at the other side of the separating plate;

a plurality of horizontal plates;

a plurality of vertical plates, the plurality of horizontal plates and the plurality of vertical plates disposed inside the accommodating space and cooperating with the casing to form a plurality of accommodating subspaces; and a plurality of covering plates, each covering plate being pivoted to the casing;

a driving unit, connected to the plurality of horizontal plates; and a computer unit, obtaining a size of an object, wherein the size of the object comprises a height of the object, a preset size is stored in the computer unit, the preset size comprises a height of the accommodating subspace, when the size of the object exceeds the preset size, the computer unit sends a driving signal to the driving unit, and the driving unit controls at least one vertical plate to move into the storage space according to the driving signal, so as to accommodate the object.

14. A method for adjusting accommodating space, applied to a locker system, wherein the locker system comprises a casing, a separating plate dividing an interior space of the casing into an accommodating space at one side of the separating plate and a storage space at the other side of the separating plate, a plurality of horizontal plates, a plurality of vertical plates and a driving unit, the plurality of horizontal plates and the plurality of vertical plates cooperate with the casing to form a plurality of accommodating subspaces, and the driving unit is connected to the plurality of horizontal plates and the plurality of vertical plates, the method comprises:

obtaining a size of an object;

determining whether the size of the object exceeds a preset size;

when the size of the object exceeds the preset size, sending a driving signal to the driving unit according to the size of the object;

controlling at least one horizontal plate or at least one vertical plate to move into the storage space according to the driving signal such that at least two accommodating subspaces are merged; and accommodating the object in the at least two accommodating subspaces.

15. The method as claimed in claim 14, further comprising:

capturing an image of the object; and obtaining the size of the object according to the image.

16. The method as claimed in claim 14, further comprising:

receiving the size of the object by a human machine interface.

17. The method as claimed in claim 14, wherein the vertical plates or the horizontal plates are stretchable plates, and are made of soft plastic.

18. The method as claimed in claim 14, wherein the step of controlling at least one horizontal plate or at least one vertical plate to move into the storage space according to the driving signal further comprises:

controlling at least one of the horizontal plates to move into the storage space when a height of the object is greater than a height of the accommodating subspace.

19. The method as claimed in claim 14, wherein the step of controlling at least one horizontal plate or at least one vertical plate to move into the storage space according to the driving signal further comprises:

controlling at least one of the vertical plates to move into the storage space when a length of the object is greater than a length of the accommodating subspace.

20. The method as claimed in claim 14, wherein the step of controlling at least one horizontal plate or at least one vertical plate to move into the storage space according to the driving signal further comprises:

controlling two of the horizontal plates and two vertical plates adjacent to the two of the horizontal plates, to move into the storage space, when a length of the object is greater than a length of the accommodating subspace, and a height of the object is greater than a height of the accommodating subspace.

* * * * *